US005176513A

United States Patent [19]

Zinn et al.

[11] Patent Number: 5,176,513

[45] Date of Patent: Jan. 5, 1993

[54] PULSE COMBUSTOR APPARATUS

[75] Inventors: Ben T. Zinn, Atlanta, Ga.; Nehemia Miller, Haifa, Israel

[73] Assignee: Georgia Tech Research Corporation, Atlanta, Ga.

[21] Appl. No.: 621,826

[22] Filed: Dec. 4, 1990

[51] Int. Cl.[5] ..... F27B 15/00

[52] U.S. Cl. ..... 432/58; 431/1; 110/245

[58] Field of Search ..... 432/58; 110/245; 431/1

[56] References Cited

U.S. PATENT DOCUMENTS

| | | | |
|---|---|---|---|
| 4,474,119 | 10/1984 | Jones | 110/245 |
| 4,476,790 | 10/1984 | Bono et al. | 122/4 D |
| 4,529,377 | 7/1985 | Zinn et al. | 432/58 |
| 4,867,079 | 9/1989 | Shang et al. | 110/245 |
| 4,938,156 | 7/1990 | Yahata | 110/245 |
| 4,962,711 | 10/1990 | Yamauchi et al. | 110/245 |
| 4,993,332 | 2/1991 | Boross et al. | 110/245 |
| 5,018,458 | 5/1991 | McIntyre et al. | 110/245 |

*Primary Examiner*—Henry C. Yuen

*Attorney, Agent, or Firm*—Hurt, Richardson, Garner, Todd & Cadenhead

[57] ABSTRACT

A pulse combustor apparatus for burning solid fuel comprises a Rijke-type combustor tube and has a rotating fuel bed for defining a primary combustion zone adjacent the fuel bed. The rotating fuel bed tends to minimize agglomeration of solid fuel and accumulation of ash during combustion by agitating the solid fuel. An inlet conduit is provided for introducing a low nitrogen gaseous fuel to the combustion air upstream of the combustion zone to minimize the formation of $NO_x$ in the primary combustion zone. In other embodiments, inlets are provided downstream of the primary combustion zone for introducing additional air or gaseous, low nitrogen fuel for air staging or reburning to minimize the emission of $NO_x$. Sorbents, such as limestone, are introduced above the bed to minimize $SO_2$ emissions.

11 Claims, 4 Drawing Sheets

PULSE COMBUSTOR APPARATUS

TECHNICAL FIELD

The present invention relates to a pulse combustor apparatus that utilizes sound waves to intensify combustion of a fuel, to increase combustion efficiency, to increase thermal efficiency, improve heat transfer, and to reduce pollution output. More particularly, the invention relates to a pulse combustor apparatus adapted for burning solid fuel.

BACKGROUND OF THE INVENTION

One problem associated with known pulse combustor apparatus of the type having a Combustor tube with open ends, i.e., a "Rijke" tube, is that it can be difficult to burn solid fuels, such as coal, therein efficiently and effectively. For example, if coal is burned in a Rijke tube using overfeed fuel bed burning, in which coal is added above a grate and air for combustion is introduced from beneath the grate, the combustor apparatus can become choked or clogged rather quickly. This clogging of the combustor apparatus is caused in part by agglomeration of the coal and in part by accumulation of ash. Agglomeration of the coal is a result of a softening or melting of some of the constituents of the coal which causes the coal particles to stick together. Agglomeration is detrimental to complete and efficient combustion in that some amount of coal inside of the agglomerated clump is not exposed to combustion air, but rather is insulated from contacting combustion air. Thus, unburned coal can accumulate on the grate in this way until the combustor tube is partially or completely clogged. The agglomerated coal also inhibits the passing of combustion air through the bed.

Ash accumulation can also act to clog the combustor tube. Ash is the inorganic residue resulting from the burning of coal and generally consists mainly of silica, alumina, ferric oxide, and lime, along with smaller amounts of other compounds. Depending upon the source of the coal, ash content can be as little as 3% of the unburned coal or more than 25%. As the coal burns, ash melts and seals over a portion of the free carbon, thereby reducing the amount of carbon that can be burned. As the combustion of coal continues over time, the ash continues to accumulate and must be removed from the fuel bed. For example, in some furnaces, though not in known Rijke pulse combustors, coal is carried into a combustion chamber from one side by a conveyor and after the coal has been burned on &he conveyor, the resulting ash is carried out of the combustion chamber by the same conveyor.

Another problem with burning solid fuels, such as coal, in a Rijke Pulse combustor is that an undesirably large amount of pollution in the form of $NO_x$ is generated and emitted. The emission of $NO_x$ can present a more difficult problem when burning some solid fuels, such as coal, than when burning gaseous or liquid fuels. This is so because many solid fuels contain small but significant amounts of bonded nitrogen. For example, coal typically contains approximately 1% to 1.5% nitrogen. During combustion, this fuel-borne nitrogen can combine with oxygen present in the combustion air to form $NO_x$ Indeed, in the combustion of coal in typical known apparatus, greater than 80% of the $NO_x$ formed is a result of fuel-borne nitrogen and less than 20% of the $NO_x$ is formed by thermal processes acting on the nitrogen component of the combustion air.

Another problem associated with burning coal is the emission of sulphur dioxide ($SO_2$) as a result of the sulphur content of the coal.

Thus, it can be seen that a need exists for a pulse combustor apparatus which can burn solid fuels, such as coal, effectively and efficiently while avoiding clogging and choking due to ash accumulation and agglomeration, and while minimizing the output of $NO_x$ and $SO_2$. It is to the provision of such therefore that the present invention is primarily directed.

SUMMARY OF THE INVENTION

In a first preferred form, the invention comprises a pulse combustor apparatus for burning solid fuels while avoiding choking and clogging due to ash accumulation and agglomeration of the coal. The pulse combustor apparatus includes a combustor tube having open ends and defining at least one combustion zone for burning solid fuel, the combustion zone being positioned to excite a standing wave in the combustion tube. Air inlet means are provided for supplying combustion air to the combustion tube and fuel inlet means are provided, for feeding solid fuel to the combustion zone. Fuel support means are positioned adjacent the combustion zone for supporting the solid fuel adjacent the combustion zone and for avoiding excessive agglomeration of the fuel and excessive accumulation of ash as the fuel burns. The fuel support means comprises a grate which is rotatably mounted within the combustor tube and is driven for rotation within the tube. This construction helps to maintain an even distribution of coal over the area of the grate and allows ash to fall therethrough, thereby avoiding excessive agglomeration of the coal and excessive accumulation of ash upon the grate.

In another preferred form, the invention comprises a pulse combustor apparatus adapted to burn solid fuel while minimizing the output of $NO_x$. In one embodiment thereof, the production of $NO_x$ is minimized by staging the combustion of the fuel. The pulse combustor apparatus comprises a combustor tube having open ends and defining a primary combustion zone and a secondary combustion zone downstream of the primary combustion zone. The combustor apparatus also includes fuel inlet means for feeding solid fuel to the primary combustion zone and fuel support means adjacent the primary combustion zone for supporting the solid fuel adjacent the primary combustion zone. Primary air inlet means are positioned upstream of the primary combustion zone for mixing air with the solid fuel for creating a fuel-rich mixture in the primary combustion zone. Secondary air inlet means are positioned downstream of the primary combustion zone for creating a mixture which is at least slightly air-rich in the secondary combustion zone. With this construction, as the fuel is burned in the primary combustion zone under fuel-rich conditions, the absence of sufficient oxygen in the primary combustion zone tends to prevent the nitrogen constituents released from the solid fuel from forming substantial amounts of $NO_x$. Rather, the nitrogen constituents form NO or $N_2$, and before the combustion is completed in the secondary combustion zone, the NO compounds tend to go to $N_2$ and $O_2$.

In another embodiment, the pulse combustor apparatus includes means for introducing a mixture of a gaseous, low nitrogen fuel and air to the combustion air at a position upstream of the primary combustion zone to burn the premixture together with the solid fuel. With this construction, as the premixture of gaseous fuel and air and the solid fuel burn in the combustion zone, nitrogen constituents which are released from the solid fuel during combustion combine with CH radicals available from the low nitrogen gaseous fuel and tend to avoid formation of $NO_x$.

In another embodiment, the pulse combustor apparatus includes a combustor tube which defines primary, secondary and tertiary combustion zones. Fuel inlet means are provided for feeding solid fuel to the primary combustion zone and primary air inlet means are provided for supplying combustion air to the combustor tube. Means are provided for supplying gaseous fuel for creating a fuel-rich mixture in the secondary zone and further means are provided for supplying secondary air for creating a mixture in the tertiary combustion zone which is at least slightly air rich. With this construction, $NO_x$ which can be formed in the combustion products of the primary combustion zone is destroyed via reaction with CH radicals which are generated in the fuel-rich secondary combustion zone. To complete the combustion process, the combustible products are burned in the tertiary, air-rich combustion zone.

In another form of the invention, sorbert is introduced above the primary combustion zone to minimize the emission of sulphur dioxide ($SO_2$).

Accordingly, it is an object of the present invention to provide a pulse combustor apparatus which can burn solid fuels effectively and efficiently.

It is a further object of the invention to provide a pulse combustor apparatus which can burn solid fuels while avoiding clogging and choking due to ash accumulation and agglomeration of fuel.

It is another object of the present invention to provide a pulse combustor apparatus adapted to burn solid fuels while minimizing the output of $NO_x$.

It is another object of the present invention to provide a pulse combustor apparatus adapted to burn solid fuels while minimizing the output of $SO_2$.

It is another object of the present invention to provide a pulse combustor apparatus which is durable in structure, efficient in use and economical in manufacture.

Other objects, features, and advantages of the present invention will become apparent upon reading the following specification in conjunction with the accompanying drawing figures.

BRIEF DESCRIPTION OF THE DRAWING FIGURES

DETAILED DESCRIPTION

Figure 1:
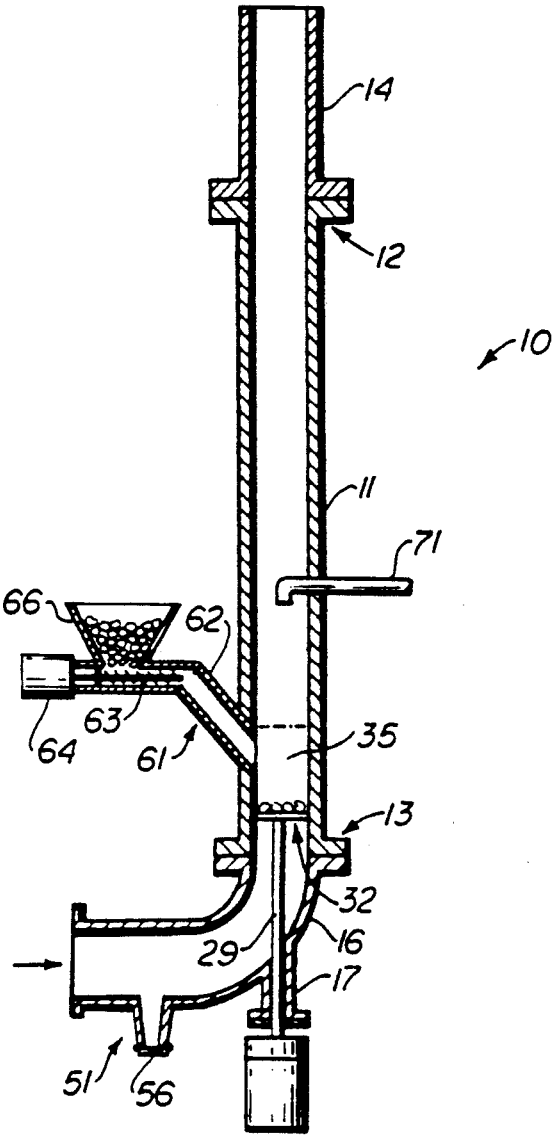
FIG. 1 is a schematic, sectional view of a pulse combustor apparatus according to a preferred form of the invention.
Figure 5:
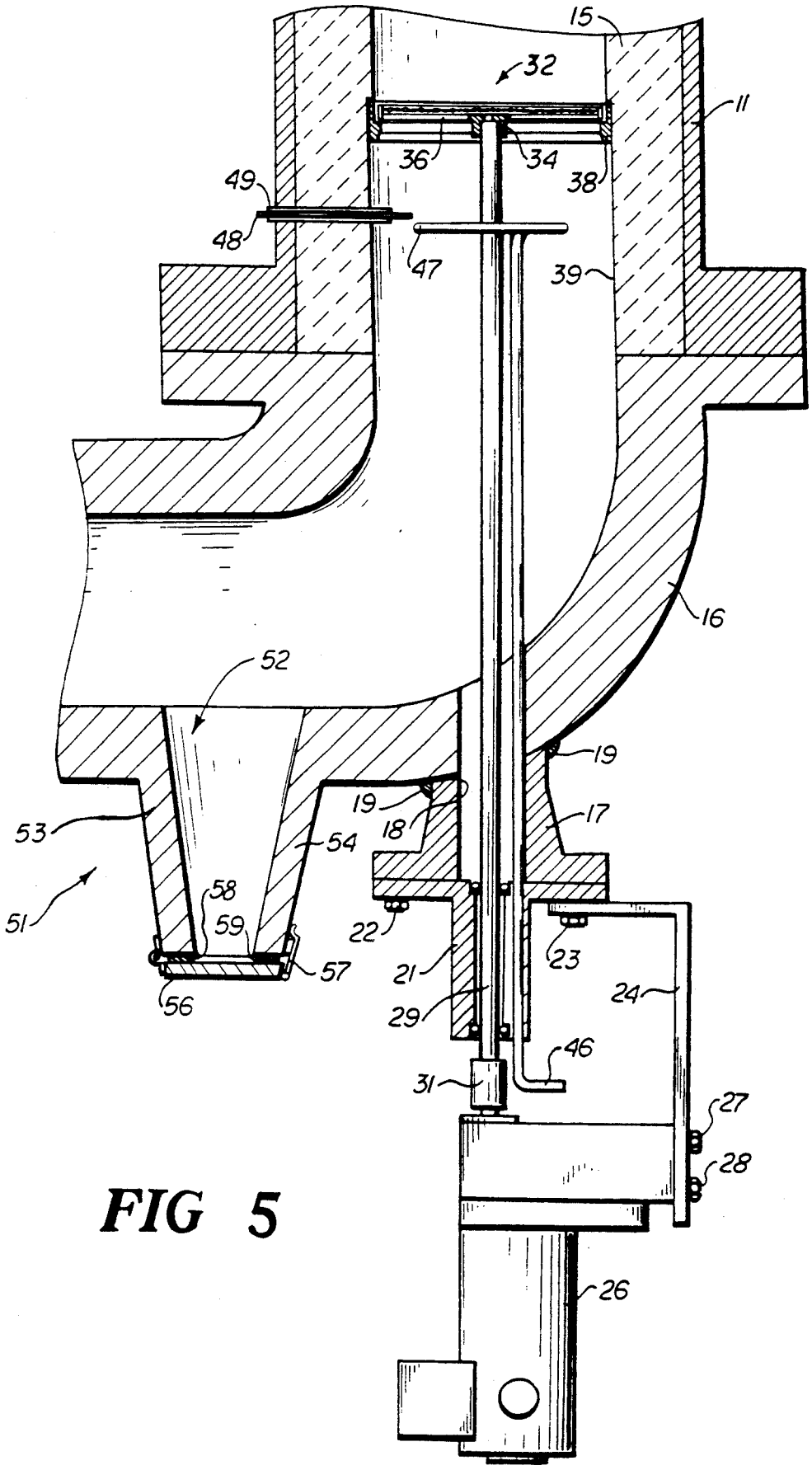
FIG. 5 is a schematic, sectional view of a portion of the pulse combustor apparatus of FIG. 1.

Referring now in detail to the drawing figures, in which like reference numerals represent like parts throughout the several views, FIG. 1 shows an improved pulse combustor apparatus 10 according to a preferred form of the invention. Pulse combustor apparatus 10 comprises a Rijke tube and includes a vertical steel intermediate tube 11 which is open at its upper end 12 and open at its lower end 13. An upper tube 14 is secured to the upper end 12 of the intermediate tube and a lower tube 16 is secured to the lower end 13 of the intermediate tube 11. Lower tube 16 is generally elbow shaped and is connected to an acoustic decoupler (not shown) at the lower end of the lower tube 16. Lower tube 16 allows combustion air to be delivered to intermediate tube 11. Likewise, upper tube 14 can be connected to an unshown exhaust stack or decoupler. Together, the lower, intermediate and upper tubes make up the combustor tube. As shown in FIGS. 1 and 5, a conduit 17 is secured to an underside of the elbow shaped lower tube 16 and a passageway 18 extends through the conduit 17 and the lower tube 16. Conduit 17 is secured to the lower tube 16 by weldments 19. A housing 21 is secured to an underside portion of the conduit 17 by means of fasteners 22 and 23. Fastener 23 also secures an L-shaped bracket 24 to the housing 21. A variable speed, DC, geared motor 26 is secured to the L-shaped bracket 24 by fasteners 27 and 28. A vertical shaft 29 is coupled to the output shaft of the motor 26 by means of coupler 31. Vertical shaft 29 extends upwardly through a bearing in the housing 21 and through a bearing in the conduit 17 into the lower tube 16 and the intermediate tube 11. The vertical shaft 29 supports and drives a rotating combustion bed assembly indicated at 32.

In the experimental embodiment actually constructed, the intermediate tube 11 is 1.83 meters long of carbon steel with an inside diameter of 0.254 meters. The intermediate tube 11 was lined with a castable ceramic insulation 15 with a thickness of 5 centimeters. The insulation 15 was "Babcock and Wilcox Kaocrete HDHS 98 RFT" and resulted in an internal passageway of approximately 15 centimeters in diameter.

The rotating combustion bed assembly is adapted to support solid fuel, such as coal, at a position within the intermediate tube 11 to define a primary combustion zone 35 which is positioned approximately ¼ of the total length of the lower, intermediate and upper tubes from the upstream end of lower tube 16. As is disclosed in U.S. Pat. No. 4,529,377 of Zinn et al., positioning the primary combustion zone at this position results in the formation of a standing acoustic mode with nodes and anti-nodes in the tube. At this location, the pulsations have both a non-zero acoustic velocity and a non-zero acoustic pressure oscillation. As disclosed in the '377 patent, this improves the combustion process significantly.

The rotating bed assembly comprises a circular metal grid or grate 33 for supporting coal thereupon and the grid is made of #6 mesh stainless steel. It is important that the rotating combustion assembly 32 include a metal grid or some type of perforated or discontinuous bed in order to allow air to flow through the bed to mix the combustion air flowing through the lower tube 16 with coal supported upon the rotating combustion bed assembly 32. Indeed, in practice it has been found that the acoustic velocity oscillations of the air passing over the coal in the coal bed are so great that instead of combustion taking place only above the bed, a significant amount of combustion of the coal takes place below the bed. The acoustic velocity oscillations cause flamelets to extend some several inches below the ed, contrary to the overall airflow through the combustor.

A generally cylindrical collar 34 is fixedly secured to an upper end portion of the vertical shaft 29. A number of carbon steel spokes, such as spoke 36, extend radially from collar 34 and are positioned beneath the circular metal, grid 33 for supporting the grid thereon. An outer rim 37 of carbon steel is secured to the spokes and is sized to be received within the inside diameter of the intermediate tube 11. With this construction, as the vertical shaft 29 is driven in rotation by the motor 26, the spokes 36, the metal grid 33 and the outer rim 37 are all driven in rotation therewith.

A seal 38 in the form of a stationary ring is affixed to the inside wall 39 of insulation 15. Seal or stationary ring 38 comprises a circular member which has a generally L-shaped cross-section to define an upper ledge surface 41 for supporting a bottom portion of the outer rim 37 thereon. An upstream portion 42 of the stationary seal 38 extends inwardly from the outer wall 39 a distance sufficient to overlap outer rim 37 so that combustion air is prevented from bypassing the coal bed by moving through the gap 43 between the outside of the outer rim 37 and the inside wall 39 of the insulation liner 15.

An unshown controller is used to control the rotational speed and direction of the rotating combustion bed assembly 32 to control the amount of refuse which falls downwardly through the openings defined in the circular metal grid.

Figure 6:
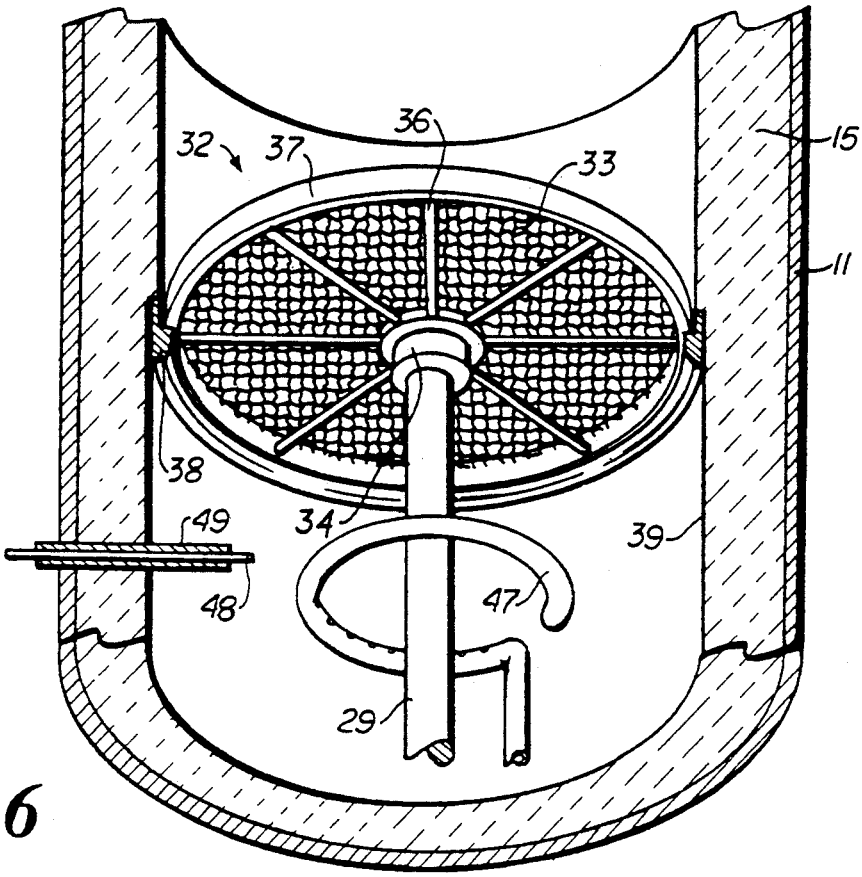
FIG. 6 is a partially cut-away, bottom perspective view of a portion of the pulse combustor apparatus of FIG. 5.

As shown in FIGS. 5 and 6, a gas inlet pipe 46 extends from outside the lower tube 16 through the passageway 18, through the lower tube 16 and into the intermediate tube 11. The gas conduit 46 terminates at and communicates with a generally circular ignitor/preheater ring 47. Fuel, such as propane, which is dispensed through the ignitor/preheater 47 is ignited by an ignitor wire 48 extending through a ceramic sleeve 49 which extends through the side of the intermediate tube 11 and the liner 15. Ignitor/preheater ring 47 is positioned below or upstream of the rotating combustion bed assembly for igniting the fuel for start-up.

In the experimental pulse combustor apparatus actually constructed, ash and other debris which fall through the grid are collected in conduit 17 for removal. For commercial applications, a more convenient means of collecting and removing debris is contemplated and such is schematically illustrated in FIGS. 1 and 5. A refuse trap indicated generally at 51 is positioned below (upstream) the rotating combustion bed assembly 32 for collecting ash, small pieces of agglomerated coal and other debris as the coal is combusted in the combustor. Refuse trap 51 is shown in exaggerated dimension to illustrate its construction; however, in practice it is important that it be configured to minimize any negative impact on the pulsations. The refuse trap 51 is positioned below an opening 52 formed in the sidewall of lower tube 16. Refuse trap 51 is generally square sided, although the sidewalls, such as sidewalls 53 and 54, can be sloped somewhat. A trap door 56 is hingedly mounted at one of its ends to sidewall 53 and is secured at another of its ends to sidewall 54 by means of a latch indicated schematically at 57. Seals 58 and 59 are provided between the trap door and bottom surfaces of the sidewalls 53 and 54.

As shown in FIG. 1, a fuel inlet means indicated at 61 is provided for feeding solid fuel to the primary combustion zone 35 defined adjacent the rotating combustion bed assembly 32. Fuel inlet means 61 comprises a conduit 62 for delivering coal therethrough, with the conduit being water cooled to prevent coal from melting and sticking due to the heat given off by the combustion in the primary combustion zone. Solid fuel, such as coal, is fed to the conduit 62 by means of an auger 63 which is driven in rotation by a motor 64. The auger 63 delivers coal from a hopper 66 and its speed is closely controlled to maintain a desired fuel feed rate.

An inlet conduit 71 extends through a sidewall of the intermediate tube 11 at a position generally downstream (above) the primary combustion zone 35. The inlet conduit 71 can be adapted for introducing therein a sorbent, such as limestone ($CaCO_3$) and dolomite ($CaCO_3$:$NgCO_3$). Alternatively, inlet conduit 71 can be adapted for introducing gaseous fuel or additional air as required.

Figure 2:
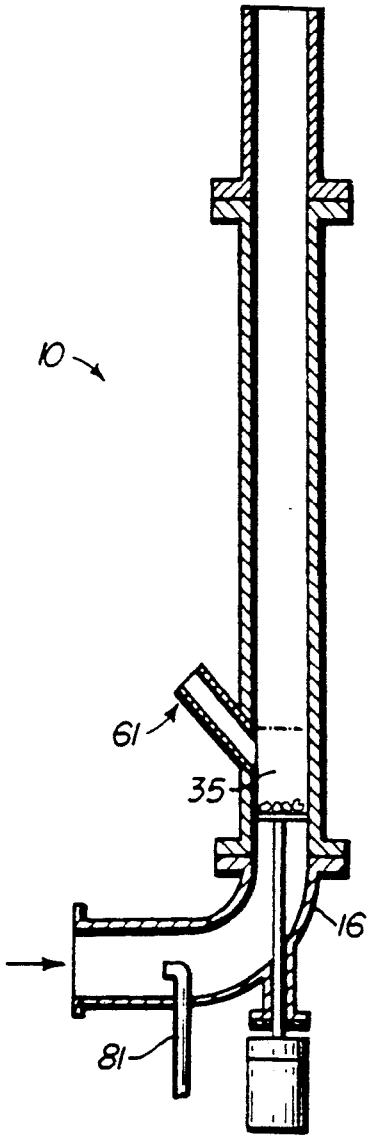
FIG. 2 is a schematic, sectional view of a pulse combustor apparatus in a second preferred form of the invention.

Having now described a first preferred form of the invention, attention is now directed to FIG. 2 which illustrates another preferred form of the invention. In FIG. 2, the construction of the overall combustor apparatus 10 is largely similar to that shown in FIG. 1, including the rotating combustion bed assembly and the fuel inlet means for delivering coal to the combustion zone. However, some details have been left out for clarity of illustration. FIG. 2 shows an inlet conduit 81 for mixing gaseous, low-nitrogen fuel with the combustion air flowing through lower tube 16 and on to the primary combustion zone 35.

Figure 3:
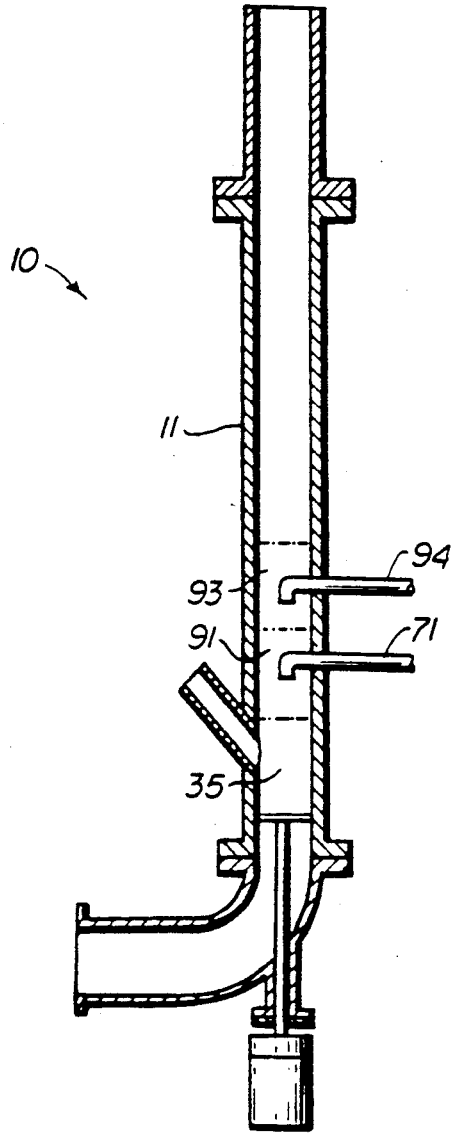
FIG. 3 is a schematic, sectional view of a pulse combustor apparatus in a third preferred form of the invention.

FIG. 3 shows yet another preferred form of the invention in which the inlet conduit 81 is done away with. In this embodiment, the intermediate tube 11 defines a primary combustion zone 35, a secondary combustion zone 91 and a tertiary combustion zone 93, with the secondary combustion zone being downstream of the primary combustion zone and the tertiary combustion zone being downstream of the secondary combustion zone. Inlet conduit 71 is positioned to discharge fuel into the secondary combustion zone 91 and an additional inlet conduit 94 is positioned to discharge air into the tertiary combustion zone 93.

Figure 4:
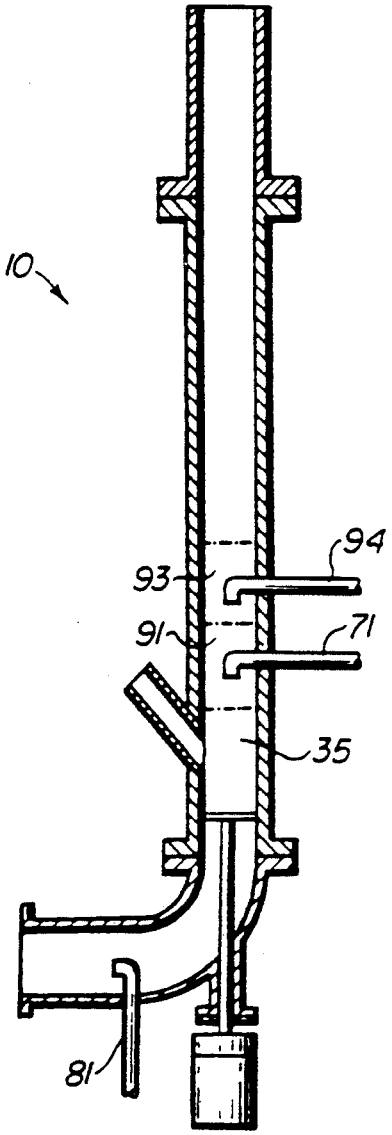
FIG. 4 is a schematic, sectional view of a pulse combustor apparatus in a fourth preferred form of the invention.

FIG. 4 shows another embodiment of the invention which is similar to that shown in FIG. 3, with the addition of inlet conduit 81 upstream of the primary combustion zone 35.

Figure 8:
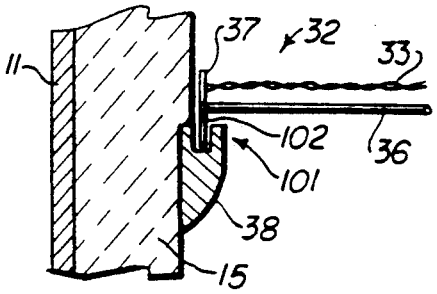
FIG. 8 is a modified form of the pulse combustor apparatus of FIG. 7.
Figure 7:
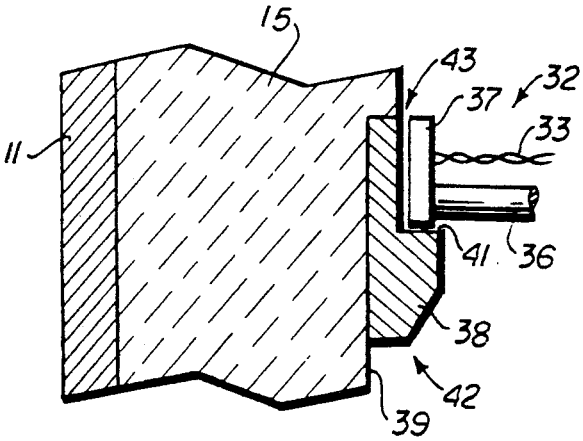
FIG. 7 is a sectional view of a portion of the pulse combustor apparatus of FIG. 6.

FIG. 8 shows an alternative construction of the rotating combustion bed 32. In this construction, the stationary ring 38 has a generally U-shaped upper portion 101 for receiving a descending leg portion 102 of outer rim 37.

A pulse combustor apparatus having a rotating combustion bed assembly for supporting solid fuel, such as coal, thereon provides substantial improvements over what is known in the prior art. For example, a rotating combustion bed assembly prevents the accumulation of excessive amounts of ash and unburned material in the bed by agitating the coal. The rotating combustion bed assembly also prevents substantial coal agglomeration in the bed. Furthermore, it results in an even distribution of the burning solid fuel and any other material which may participate in the combustion process in the bed. This even distribution results in an improved and more uniform combustion process within the combustion zone. As the solid fuel is fed into the combustion chamber by the fuel inlet means 61, and as it drops downwardly onto the bed, the rotation of the combustion bed assembly causes the fuel to be evenly distributed across the bed.

The rotating combustion bed assembly also enables the combustor to operate continuously over long periods of time without the necessity of stopping operation to remove accumulated ash or agglomerated coal which might have clogged the combustor. Also, the even distribution across the rotating bed tends to provide for rather constant Performance of the combustor over time, thereby making it easier to address the pollution emission problems. Furthermore, the rotating combustion bed assembly provides simple means for attaining uniform distribution of the combustible material on the bed while using only one material feed port.

The embodiment shown in FIG. 2 also offers substantial performance improvements over what is shown in the prior art. FIG. 2 shows a configuration of a pulse combustor apparatus adapted for "premixing" a low-nitrogen gaseous fuel with combustion air to control the performance of the pulse combustor apparatus to reduce $NO_x$ emissions from the combustor. In the typical solid fuel burning Rijke-type pulse combustors known, the combustion air enters the bed from below and the fuel is applied from the top (overfeed). The air reacts with the fuel in the primary combustion zone adjacent the fuel bed. According to the invention shown in FIG. 2, the primary combustion airflow is premixed with a given flow rate of a gaseous fuel having small or no amounts of nitrogen (e.g., propane, methane, etc.) prior to entering the combustion zone to minimize the production and emission of $NO_x$. During combustion, the nitrogen constituents which are released from the solid fuel readily combine with the CH radicals present in the premixed gaseous fuel and air mixture to "tie up" the nitrogen and prevent it from forming $NO_x$.

Premixing fuel also allows the combustor to be operated in a pulsating mode under highly fuel rich conditions in which the combustor is essentially operating as a solid fuel gasifier.

The gaseous fuel can also be used to stop the pulsations as required. For example, experience has shown that pulsations stop when a gaseous flame is established at a location below the primary combustion zone. Thus, by igniting the stream of injected gaseous fuel and air before it enters the bed, it is possible to interrupt the pulsations. Pulsating operation can be reinitiated by simply extinguishing the flame below the bed and letting the premixed gaseous fuel mixture burn in the bed along with the coal.

$NO_x$ emissions can also be reduced by "reburning" using a configuration as shown in FIG. 3. Reburning refers to the burning of a fuel in a secondary, fuel rich combustion zone downstream of the primary combustion zone. In the secondary combustion zone a gaseous, low nitrogen fuel (i.e., a fuel which has little or no nitrogen content) is introduced and reacts with the oxygen present in the hot combustion products from the primary combustion zone. During reburning, $NO_x$ which is present in the combustion products of the primary combustion zone is destroyed by reaction with the CH radicals which are generated in the fuel rich secondary combustion zone. To complete the combustion, the combustible products which are present in the secondary combustion zone are typically burned in a third or tertiary, air rich combustion zone. This is accomplished by introducing additional air downstream of the secondary combustion zone for reacting with the combustion products of the secondary combustion zone in a third or tertiary combustion zone. To minimize formation of $NO_x$ in the tertiary combustion zone, the temperature in the tertiary combustion zone should be maintained below that at which $NO_x$ is formed by "thermal processes". Reburning in a Rijke-type pulse combustor apparatus such as that shown in FIG. 3 offers the advantage of minimizing $NO_x$ emissions during combustion of solid fuels, many types of which typically have a high nitrogen content. The pulsations accelerate the mixing between reactants in the secondary and the tertiary combustion zones thereby reducing residence times and combustion zone lengths required to complete combustion in the combustion zones. In this way, the overall length of the Rijke-type combustor apparatus can be minimized. Pulsations also tend to enhance the cooling of the combustion products of the second combustion zone prior to their entrance into the third combustion zone where they react with the additional air. This tends to ensure that the combustion process in the tertiary combustion zone is carried out at temperatures which are not conducive to formation of $NO_x$.

The emission of $NO_x$ from a Rijke-type pulse combustor apparatus can also be minimized by a process known as "air staging" using a configuration such as that shown in FIG. 1. In air staging the solid fuel is burned in a fuel rich primary combustion zone by limiting the amount of primary air introduced to the combustion zone through the primary air inlet or by adding extra fuel through the fuel inlet. By having insufficient air at the primary combustion zone, the oxygen which is present in the combustion air tends to be consumed in oxidizing the hydrocarbons present in the fuel, rather than being available for combining with the nitrogen present in both the air and in the fuel to form $NO_x$. However, there is some formation of NO which is unstable and which tends to go to either $N_2$ or $NO_x$. After the solid fuel has been partially combusted in the primary combustion zone, the combustion process is completed downstream of the primary combustion zone by adding additional air such as through conduit 71, to create a secondary, air rich combustion zone. By adding the necessary air at the secondary combustion zone, the efficiency of the overall combustion process is recaptured. The temperature at the primary combustion zone always is higher than the temperature at the secondary combustion zone due to heat losses. Because of this, it is possible to keep the temperature in the secondary combustion zone at a low enough level to, prevent the NO from forming $NO_x$ but rather the NO tends to form $N_2$ and $O_2$. It may be necessary in some applications to provide a source of ignition in the secondary combustion zone.

Inlet conduit 71 can also be used as shown in the configuration of FIG. 1 to minimize the emission of sulfur dioxide from a Rijke-type pulse combustor apparatus. By introducing sorbent materials, such as limestone or dolomite, to the flow of combustion gases downstream of the primary combustion zone, sulfur dioxide ($SO_2$) emissions can be reduced. Naturally occurring limestone ($CaCO_3$) and dolomite ($CaCO_3$:$MgCO_3$) have been found to be good sorbents, with the former being better suited for atmospheric pressurized fluidized beds and the latter more suited to pressurized fluidized beds. In atmospheric pressure fluidized beds, the limestone is first calcined in the endothermic reaction as follows: $CaCO_3 = CaO + CO_2$. This endothermic reaction readily occurs at temperatures well below the bed temperature. The calcined limestone then reacts with the sulfur dioxide in the following reaction: $2CaO + 2SO_2 + O_2 = 2CaSO_4$.

Accordingly, it can be seen that the present invention provides a pulse combustor apparatus which can burn solid fuels effectively and efficiently while avoiding clogging and choking due to ash accumulation and agglomeration of the solid fuel. Furthermore, the pulse combustor apparatus minimizes the output of $NO_x$ and $SO_2$ while burning solid fuels. The pulse combustor apparatus according to the Present invention also tends to be extremely durable in operation, requiring less down time to remove accumulated debris.

While the invention has been disclosed in preferred forms only, it will be understood by those skilled in the art that many modifications, additions and deletions may be made therein without departing from the spirit and scope of the invention as set forth in the appended claims.

We claim:

1. A pulse combustor apparatus adapted for burning solid fuel, comprising:

a combustor tube having a generally circular interior cross-section and open ends and defining at least one combustion zone for burning solid fuel, said combustion zone being positioned to excite a standing acoustic wave in said combustor tube;

air inlet means for supplying combustion air to said combustion zone of said combustor tube;

fuel inlet means for feeding solid fuel to said combustion zone;

fuel support means adjacent said combustion zone for supporting the solid fuel adjacent said combustion zone, said fuel support means having a generally circular periphery and being essentially coextensive with said generally circular interior cross-section of said combuster tube and comprising a grate having at least one opening therethrough located interiorly of said periphery, said at least one opening allowing ash produced as the solid fuel burns to fall therethrough yet preventing the majority of the unburned solid fuel from falling therethrough, said fuel support means being rotatably mounted within said combustor tube; and means for driving said grate in rotation; wherein the configuration of the grate allows the combustion air to travel therethrough and through the solid fuel, thereby providing efficient combustion of the solid fuel, and further allows the ash produced as the fuel burns to fall therethrough, thereby avoiding excessive accumulation of ash on the fuel support means.

2. A pulse combustor apparatus as claimed in claim 1 further comprising means for preventing substantial air flow between said periphery of said fuel support means and an inside wall of said combustor tube.

3. A pulse combustor apparatus as claimed in claim 1 further comprising means for collecting ash and other debris, said means for collecting ash being positioned below said combustion zone.

4. A pulse combustor apparatus as claimed in claim 3 wherein said means for collecting ash comprises means for discharging collected ash from said combustor tube.

5. A pulse combustor apparatus as claimed in claim 1 further comprising sealing means mounted to an inside wall of said combustor tube for sealing an outer portion of said fuel support means to said inside wall of said combustor tube.

6. A pulse combustor apparatus as claimed in claim 1 further comprising means for preheating and igniting fuel supported adjacent said combustion zone, said means for preheating and igniting being positioned below said combustion zone,

7. A pulse combustor apparatus as claimed in claim 1 further comprising means for introducing a gaseous, low-nitrogen fuel to the combustion air prior to said combustion zone to mix the gaseous fuel with the combustion air.

8. A pulse combustor apparatus as claimed in claim 1 wherein said combustion zone comprises a primary combustion zone and wherein said air inlet means comprises primary air inlet means for creating a fuel rich mixture in said primary combustion zone, said apparatus further comprising a secondary combustion zone downstream of said primary combustion zone and secondary air inlet means downstream relative to said air inlet means of said primary combustion zone for creating a mixture which is at least slightly air-rich in said secondary combustion zone.

9. A pulse combustor apparatus as claimed in claim 1 wherein said combustion zone comprises a primary combustion zone and wherein said air inlet means comprises primary air inlet means, said apparatus further comprising secondary and tertiary combustion zone, gaseous fuel inlet means for creating a fuel-rich mixture in said secondary zone, and secondary air inlet means for creating a mixture which is at least slightly air-rich in said tertiary combustion zone.

10. A pulse combustor apparatus as claimed in claim 1 further comprising means for limiting the creation and discharge of $NO_x$.

11. A pulse combustor apparatus adapted for burning solid fuel as claimed in claim 1, further comprising:

means for reducing the emission of sulfur dioxide from the combustor apparatus comprising a means for introducing a sorbent to the combustion air at a position downstream of said combustion zone.

* * * * *

UNITED STATES PATENT AND TRADEMARK OFFICE

CERTIFICATE OF CORRECTION

PATENT NO. : 5,176,513

DATED : January 5, 1993

INVENTOR(S) : ZINN, et al.

It is certified that error appears in the above-indentified patent and that said Letters Patent is hereby corrected as shown below:

Column 1, line 3, insert

STATEMENT OF GOVERNMENT INTEREST

This invention was made with government support under Contract No. DE-AS04-85AL31881 awarded by the Department of Energy. The government has certain rights in the invention.

Signed and Sealed this

Sixth Day of December, 1994

*Attest:*

*Attesting Officer*

Bruce Lehman

BRUCE LEHMAN

*Commissioner of Patents and Trademarks*